US006765496B2

(12) United States Patent
Dayan

(10) Patent No.: US 6,765,496 B2
(45) Date of Patent: Jul. 20, 2004

(54) LIGHT CONTROLLER WITH SENSITIVITY CONTROL

(75) Inventor: Mervin A. Dayan, Oakhurst, NJ (US)

(73) Assignee: Roadmaster (USA) Corp., Eatontown, NJ (US)

( * ) Notice: Subject to any disclaimer, the term of this patent is extended or adjusted under 35 U.S.C. 154(b) by 87 days.

(21) Appl. No.: 09/999,153

(22) Filed: Oct. 30, 2001

(65) Prior Publication Data

US 2003/0081405 A1 May 1, 2003

(51) Int. Cl.[7] ..... G08G 1/16; H04R 29/00

(52) U.S. Cl. ..... 340/903; 367/199; 381/56; 381/58; 381/59; 84/464 R; 362/86

(58) Field of Search ..... 340/902, 903, 340/904; 367/197–199; 381/56, 58, 59; 84/464 A, 464 R; 362/86, 253, 276, 811

(56) References Cited

U.S. PATENT DOCUMENTS

| | | | | |
|---|---|---|---|---|
| 1,790,903 A | | 2/1931 | Craig | 84/464 R |
| 3,038,061 A | | 6/1962 | O'Reilly | 381/150 |
| 3,240,099 A | | 3/1966 | Irons | 84/464 R |
| 3,473,429 A | | 10/1969 | Tandberg | 84/464 R |
| 3,478,837 A | | 11/1969 | Ross | 181/743 |
| 3,540,343 A | | 11/1970 | Rifkin | 84/464 |
| 3,927,402 A | | 12/1975 | Thompson | 340/45 |
| 4,346,640 A | | 8/1982 | Zeno et al. | 84/464 R |
| 4,389,598 A | | 6/1983 | Smith | 315/291 |
| 4,791,536 A | | 12/1988 | James | 362/104 |
| 4,809,584 A | | 3/1989 | Forrest | 340/815.11 |
| 4,875,143 A | * | 10/1989 | Fernandez | 362/86 |
| 4,889,027 A | | 12/1989 | Yokoi | 84/635 |
| 5,056,399 A | | 10/1991 | Hornstein | 340/815.11 |
| 5,191,319 A | | 3/1993 | Kiltz | 340/815.1 |
| 5,365,149 A | | 11/1994 | Blakeslee et al. | 315/200 A |
| 5,485,355 A | | 1/1996 | Voskoboinik et al. | 362/84 |
| 5,772,307 A | * | 6/1998 | Philyaw | 362/86 |
| 5,818,342 A | | 10/1998 | Solomon et al. | 340/815.46 |
| 5,886,304 A | * | 3/1999 | Schlenzig et al. | 181/155 |
| 6,000,493 A | * | 12/1999 | Chen | 181/141 |
| 6,144,752 A | | 11/2000 | Chen | 381/386 |
| 6,164,792 A | | 12/2000 | Nakagome | 362/86 |

* cited by examiner

*Primary Examiner*—Donnie L. Crosland
(74) *Attorney, Agent, or Firm*—Robert F. Zielinski, Esq.; Wolf, Block, Schorr & Solis-Cohen, LLP

(57) ABSTRACT

A light control device and method are provided for receiving an audible signal from an audio speaker and outputting a light control signal, whereby the light control signal controls the illumination of a light source placed near the audio speaker.

7 Claims, 5 Drawing Sheets

LIGHT CONTROLLER WITH SENSITIVITY CONTROL

BACKGROUND OF THE INVENTION

Audio or stereo systems are often used to provide audible entertainment. The audible signal from the stereo system may derive from a variety of sources, such as CDs, tapes, DVDs, MP3 recordings, vinyl records and/or radio stations. Audiophiles (i.e., people with passionate interests in stereo or high fidelity sound reproduction) and others who enjoy stereo systems are always seeking ways to enhance the quality of their listening experience.

One way to provide such enhancement is to add a visual aspect to aural perception. For instance, speakers of a stereo system may include a light source, such as a neon light, to provide visual effects in conjunction with the audible sound. Such visual enhancement can be used to reflect the personal tastes of a listener, much as customizing a car by employing components such as spoilers, chrome wheel covers and tinted windows express the car owner's personality.

In one example of using light to enhance the listening experience, car stereo speakers may be fitted with a light source placed near the speaker. In particular, a neon light may be fitted over the speaker grill. In the past, neon lights may have been employed to light whenever the stereo was on. Or, the lights may have been programmed to turn on and off in a predetermined manner. Also, the lights may have been connected between an audio source and the speaker so as to turn on in direct response to the audio source. For example, a light source may have been electrically connected to a ground wire of the speaker such that the light was turned on at the same time the speaker was activated by the audio source. However, these alternatives provide little control, if any, to the user who may wish to adjust the operation of the light in response to the music or her mood.

SUMMARY OF THE INVENTION

The present invention provides a light controller with sensitivity control that allows a user to fully customize light operation.

In one embodiment of the present invention, a light control device is provided for controlling visual display of a light source. The device includes a transducer for receiving an audible signal produced by a speaker. The speaker is remote from (i.e., physically unconnected to) the transducer. In the case where the speaker is mounted in a car, the speaker may, for example, be located in the trunk or a rear portion of the car while the transducer may be located near the dashboard. The transducer forms an output based upon the received audible signal. A light controller is operable to receive the output signal and form a light control signal. A light source is operably controlled by the light control signal. In one example of this embodiment, the light source is operably controlled by being turned on and off in response to the light control signal.

In another example of this embodiment, the light control signal is formed automatically based upon music. In this example, the device does not require user operation. In yet another example, the light control signal is formed in response to user control. This example provides the user more flexibility in operating the device.

Preferably the device further includes a sensitivity adjuster. The sensitivity adjuster is connected to the transducer to receive the output signal. The sensitivity adjuster forms an adjusted signal that is output to the light controller.

Preferably the light control device includes selectable operation modes. A first mode may be selected in which the light control signal is operable to turn the light source on continuously. A second mode may be selected in which the light control signal is operable to turn the light source off. A third mode may be selected in which the light control signal is operable to turn the light source on and off in response to the audible signal.

In another preferred embodiment, a light control device is provided. The light control device includes an audio input for receiving an audible signal. The audio input produces an output signal based upon the audible signal. The device also includes a sensitivity adjuster. The sensitivity adjuster is connected to the audio input to receive the output signal and form an adjusted signal. The device also includes a light controller. The controller receives the adjusted signal and forms a light control signal. The light control signal is operable to adjustably control a light source.

Preferably, the adjusted signal is operable to vary along a volume range. A minimum adjustment corresponds to a minimum volume. A maximum adjustment corresponds to a maximum volume. The volume range relates to a volume of the audible signal. The light source is operable to illuminate in relation to the volume range. The sensitivity adjuster is preferably a transducer or a potentiometer.

An apparatus is provided in another preferred embodiment of the present invention. The apparatus includes a transducer, a sensitivity adjuster, a light controller and a speaker unit. The transducer is for receiving an audible signal produced by a remote speaker and creating an output signal based upon the audible signal. The sensitivity adjuster is connected to the transducer, and receives the output signal. The sensitivity adjuster forms an adjusted signal from the output signal. The light controller receives the adjusted signal and forms a light control signal. The light control signal is operable to adjustably control a light source. The speaker unit includes a housing and a speaker in the housing. The light source is disposed adjacent to the housing. Preferably, the light source is a neon light.

Preferably, the housing of the apparatus includes a speaker input and a light control input. The speaker input is operable to drive the speaker. The light control input is preferably in proximity to the speaker input. The light control input is connected to the light source and is operable to receive the light control signal and pass that signal to the light source.

Yet another embodiment of the present invention is a method of controlling at least one light source. An audible signal is received from an audio speaker. Then, a sensitivity-adjusted signal is created based upon the audible signal. The sensitivity-adjusted signal is responsive to a volume of the audible signal. Then, a light control signal is output in relation to the sensitivity-adjusted signal. The light sources are controlled in response to the light control signal. For example, one of the light sources may illuminate in relation to the audible signal. If the sensitivity-adjusted signal is set to a maximum volume, the light source may illuminate when the audible signal produces a sound, no matter how soft. If the sensitivity-adjusted signal is set to a minimum volume, the light source may illuminate only when the audible signal produces a relatively loud sound.

The method of controlling at least one light source preferably includes selecting a mode of operation during the stage of outputting the light control signal. A first mode may be selected in which the light control signal is, operable to turn the light source on continuously. A second mode may be selected in which the light control signal is operable to turn the light source off. A third mode may be selected in which the light control signal is operable to turn the light source on and off in response to the audible signal.

The method preferably includes adjusting the sensitivity-adjusted signal along a volume range. The volume range varies between a minimum adjustment and a maximum adjustment. The minimum adjustment corresponds to a minimum volume. The maximum adjustment corresponds to a maximum volume. The light source is operable to illuminate in relation to the volume range. Preferably, the sensitivity-adjusted signal is formed in response to user control.

The foregoing aspects of the present invention will be further appreciated when considered with reference to the following description of the preferred embodiments and accompanying drawings.

DETAILED DESCRIPTION

The present invention allows a user to control a light source in relation to an audible signal. For example, a user can control the display of one or more light sources to create visual effects in relation to the beat of the music playing on a stereo system. Generally, the light controller receives an audible signal output from a speaker, adjusts the received audible signal according to the user's preferences, and outputs a light controlling signal which drives a light source proximate to the speaker.

Figure 1:
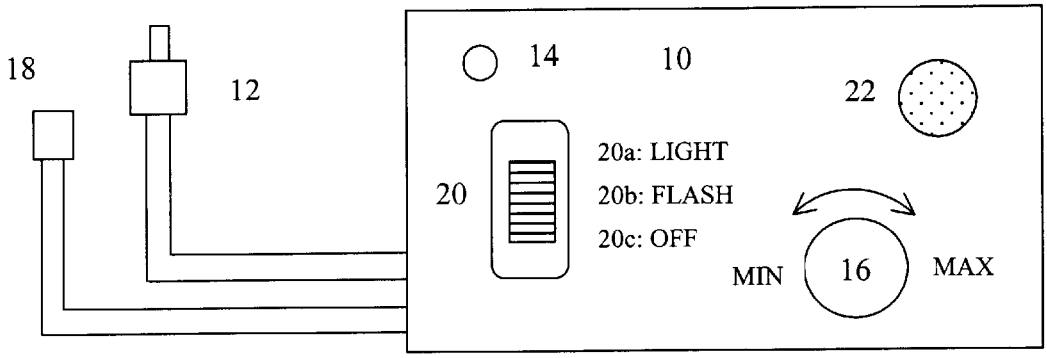
FIG. 1 is a block diagram of a light controller according to a preferred embodiment of the present invention having several customization options and a single speaker output.

The specific features of the present invention will be discussed in relation to the figures. FIG. 1 is a block diagram of controller 10 according to a preferred embodiment of the invention for controlling a single light source. Controller 10 includes connectors 12 and 18, power indicator 14, sensitivity adjuster 16, controller switch 20, and audio input 22.

Controller 10 is powered through connector 12. If the controller is used to control a light source in, for example, a car, then connector 12 is preferably a car cigarette adaptor plug. Alternatively, connector 12 can be adapted to be wired directly into the car's electrical system. If the controller is used to control a light source in conjunction with a home stereo system, then connector 12 is preferably a standard two-prong adaptor that fits into a conventional wall outlet. Other power connector types will be evident to those skilled in the art. Alternatively, controller 10 may be battery powered for more portable use.

The light source is controlled by connector 18. Connector 18 can be a standard audio jack or plug, or other connection. Connector 18 can be direct wiring between controller 10 and the light source. In an alternative embodiment, controller 10 may connect to the light source using wireless connection means. For instance, controller 10 may connect to the light source through a radio frequency or infrared signal.

Power indicator 14 comprises a light emitting diode or other visual indicator that illuminates to show that controller 10 is operating when power is supplied.

Controller switch 20 of controller 10 provides the user with various modes of operation. In this case, three options are shown. If the user selects 'light' option 20*a,* the light source (not shown) may always be turned on when controller 10 is on. If the user chooses 'off' option 20*b,* the light source will not be illuminated in response to the audible signal. If the user selects 'flash' 20*c,* then the light source may flash or change visually in response to the audible signal. Different visual effects of the light source are possible, including, but not limited to flashing or pulsing on and off, dimming and brightening, and changing color.

Controller 10 includes an audio input 22 to receive audible information such as audible music signals generated from one or more speakers. The input may be a transducer or microphone, for example.

Controller 10 preferably includes a sensitivity adjuster 16 operable to adjust the signal output from audio input 22. Preferably, sensitivity adjuster 16 comprises an adjustable transformer or potentiometer.

In one embodiment, sensitivity adjuster 16 ranges between a minimum and maximum volume. If the adjuster is set to a maximum volume, the light control signal causes the light source to illuminate during the receipt of an audible signal by controller 10. If the adjuster is set to a minimum volume, the light control signal may cause the light source to not illuminate at all, or alternatively, may cause the light source to illuminate only in response to a very strong audible signal received by controller 10. Selecting a sensitivity between the maximum and minimum volume will have an intermediate effect, such as causing the light source to illuminate only in response to an audible signal of intermediate strength. The audible signal may be within the range of human hearing, or may be below or above the range of human hearing. As a first example, the audible signal may be of very low frequency, such as 20 Hz, whereby the beat of the audible signal can be felt by actuation of a subwoofer, but cannot be heard by the human ear. As a second example, the audible signal may be of very high frequency, such as 25 KHz. Therefore, it is possible for the light source to illuminate even when the audible signal is beyond the range of human hearing.

In another embodiment, sensitivity adjuster 16 may range between a minimum and maximum brightness. Preferably, sensitivity adjuster 16 comprises an adjustable transformer or potentiometer to control the brightness. For example, if the adjuster is set to a maximum brightness, then the light control signal will cause the light source to have maximum illumination when it turns on (which may be on all the time or on in response to the beat of the music, as described above). If the adjuster is set to a minimum brightness, then the light control signal may cause the light source to have minimum illumination when it turns on. Selecting a sensitivity between the maximum and minimum brightness will have an intermediate effect, such as causing the light source to light up at an intermediate illumination level. The circuitry for implementing the various embodiments of the controller are well-known to those skilled in the electrical arts.

Figure 2:
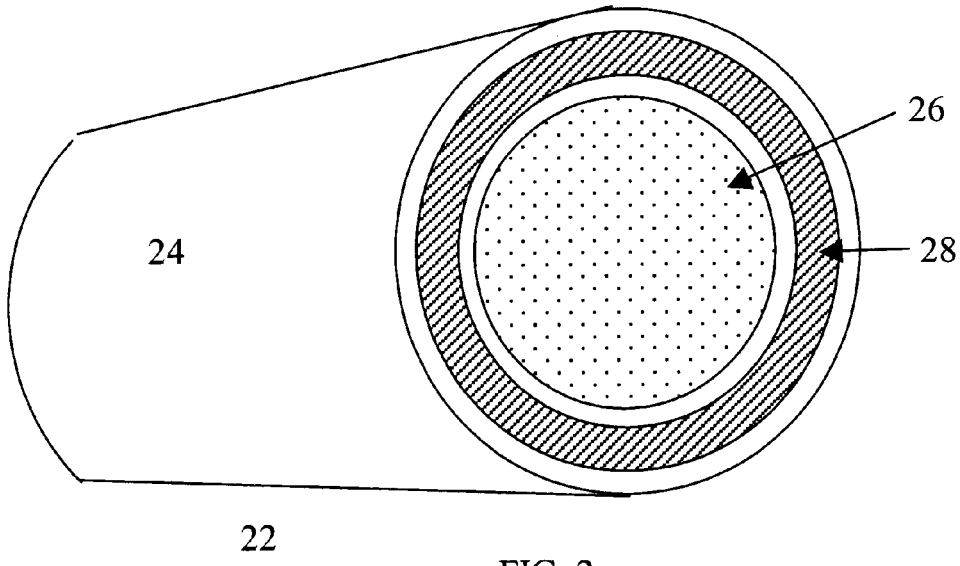
FIG. 2 is an illustration of a speaker unit including a neon light controllable according to the light controller of FIG. 1.

FIG. 2 illustrates a speaker unit 22 integrated with a light that can be operated by a controller according to the embodiment of FIG. 1. Speaker unit 22 includes case 24, grill cover 26 and neon light 28. Within case 24 is a speaker (not shown).

Grill 26 covers the front of speaker system 22. One purpose of grill cover 26 can be to protect the speaker. Another purpose of grill cover 26 can be to provide a visually pleasing appearance. Grill cover 26 can be one of a variety of materials, such as wire mesh, cloth, or other materials that allow audible sound to pass from the speaker unit to a listener.

Surrounding grill 26 is neon light 28. The light is connected to controller 10 such that it illuminates according to control options set by the user. Neon light 28 can be formed in many different shapes and sizes. While neon light 28 shown in FIG. 2. is disposed about the grill, the light does not have to be adjacent to the speaker unit. The light may be placed apart from the speaker unit depending upon the effect desired by the user.

Figure 3:
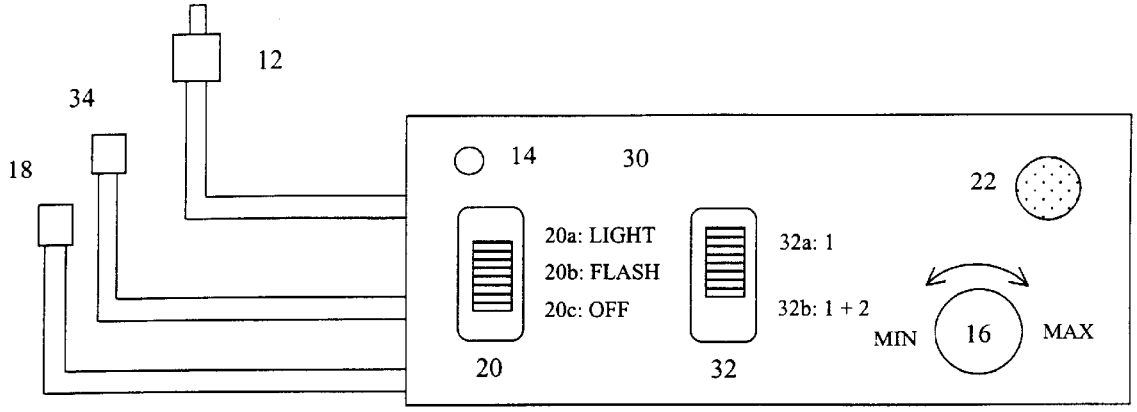
FIG. 3 is a block diagram of a light controller according to another preferred embodiment of the present invention including multiple customization options and a dual speaker output.

FIG. 3 illustrates controller 30 according to another preferred embodiment of the invention. Controller 30 is operable to control two light sources, and includes connectors 12, 18 and 34, power indicator 14, sensitivity adjuster 16, controller switch 20, audible input 22, and switch 32.

Controller 30 is powered through connector 12. If the controller is used to control a light source in, for example, a car, then connector 12 is preferably a car cigarette adaptor plug. Alternatively, connector 12 can be adapted to be wired directly into the car's electrical system. If the controller is used to control a light source in conjunction with a home stereo system, then connector 12 is preferably a standard two-prong adaptor that fits into a conventional wall outlet. Other power connector types will be evident to those skilled in the art. Alternatively, controller 30 may be battery powered for more portable use.

Power indicator 14 comprises a light emitting diode or other visual indicator that illuminates to show that controller 30 is operating when power is supplied.

Controller switch 20 of controller 30 provides the user with various modes of operation. In this case, three options are shown. If the user selects 'light' option 20*a,* the light source (not shown) may always be turned on when controller 30 is on. If the user chooses 'off' option 20*b,* the light source will not be illuminated in response to the audible signal. If the user selects 'flash' 20*c,* then the light source may flash or change visually in response to the audible signal. Different visual effects are possible, including, but not limited to flashing or pulsing on and off, dimming and brightening, and changing color.

Controller 30 includes an audio input 22 to receive audible information such as audible music signals generated from one or more speakers. Audio input 22 may be a transducer or microphone, for example.

Preferably, a sensitivity adjuster 16 is used to adjust the light control signal supplied to the light sources from controller 30. Preferably, sensitivity adjuster 16 includes an adjustable transformer or potentiometer, which is operative to adjust the audible signal received by audio input 22.

In one embodiment, sensitivity adjuster 16 ranges between a minimum and maximum volume. If the adjuster is set to a maximum volume, the light control signal causes the light sources to illuminate during the receipt of an audible signal by controller 30. If the adjuster is set to a minimum volume, the light control signal may cause the light sources to not illuminate at all, or alternatively, may cause the light sources to illuminate only in response to a very strong audible signal received by controller 30. Selecting a sensitivity between the maximum and minimum volume will have an intermediate effect, such as causing the light source to illuminate only in response to an audible signal of intermediate strength.

Controller 30 includes switch 32, which determines whether controller 30 operates one or more light sources. In one embodiment, switch 32 operates one or two light sources. For example, when switch 32 is set to the '1' position 32*a,* then a first light is powered through connector 18. When switch 32 is set to the '1+2' position 32*b,* the first light is powered through connector 18 and a second light is powered through connector 34. Alternative embodiments are possible, such as selecting light 1 or 2 or both 1 and 2. Or more than two lights may be operated in a manner similar to the described herein.

Figure 4:
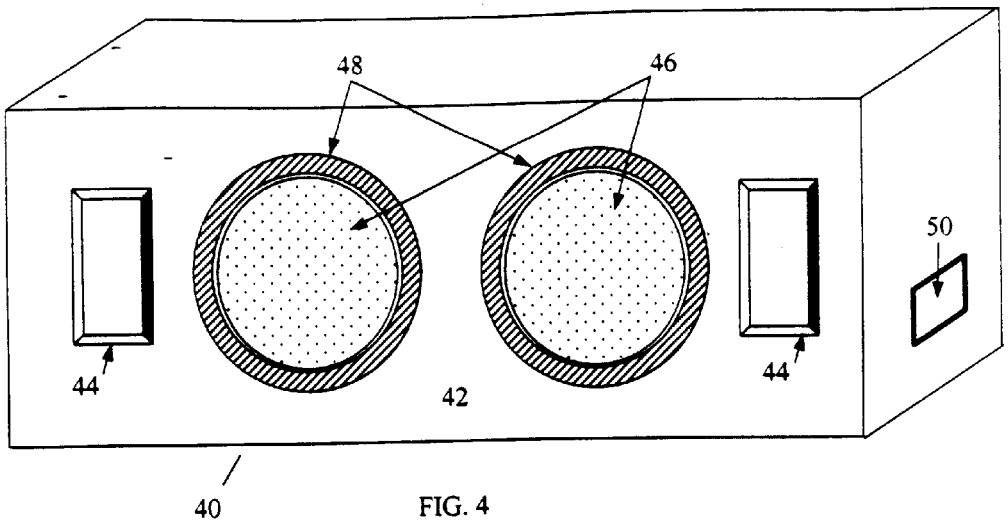
FIG. 4 is a front perspective view of a speaker cabinet including a pair of stereo speakers and neon lights operable to be controlled by the light controller of FIG. 3.

FIG. 4 illustrates a front perspective of speaker and light system 40 mounted in a cabinet with lights that may be operated by a controller according to the embodiment of FIG. 3. Speaker and light system 40 includes front 42, tweeters 44, bass speakers (not shown), grill covers 46, lights 48, and subwoofer 50.

Front 42 of the cabinet houses tweeters 44 and bass speakers (not shown) behind grill covers 46. Another speaker 50, such as a subwoofer, is optionally on a side of the cabinet. Surrounding grills 46 are circular neon lights 48. The lights are connected to controller 30, as is shown in FIG. 5, such that they illuminate according to control options desired by the user.

Figure 5:
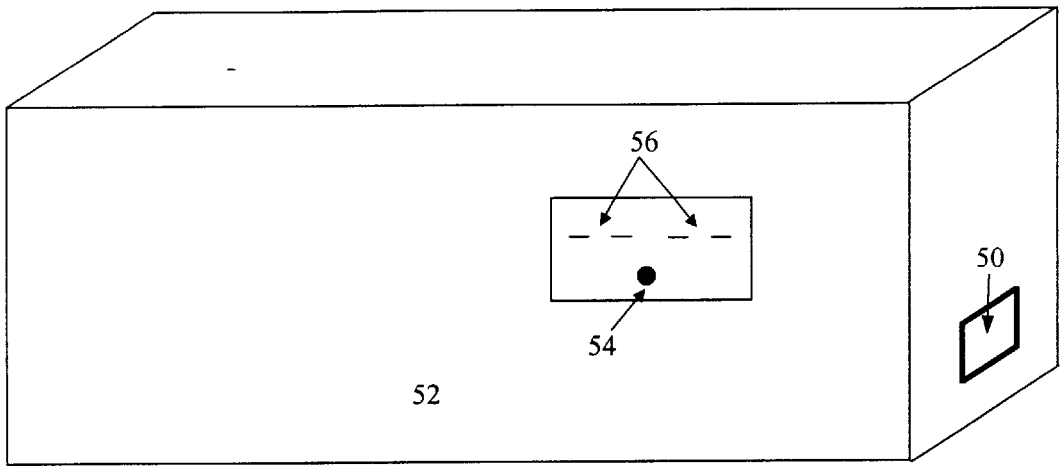
FIG. 5 is a rear perspective view of the speaker cabinet of FIG. 4.

FIG. 5 illustrates a rear perspective view of speaker and light system 40. Back 52 of the cabinet includes inputs 56 and 54 for the speakers and the lights, respectively. Connections 56 may receive speaker wire, for example, for the two sets of speakers contained within cabinet 40. Input 54 is operable to receive one or both of connectors 18 and 34, which control operation of circular neon lights 48. Because the connection of input 54 is located on the same region of the speaker cabinet as speaker inputs 56, a user is able to quickly and conveniently set up and maintain speaker and light system 40.

The light control device of the present invention may operate in a number of manners. For example, an audible signal may be received from an audio or sound source. A sensitivity control switch, or sensitivity adjuster may adjust the received audible signal. For example, the sensitivity control switch may include a potentiometer or transformer, whereby a user can adjust the potentiometer or transformer to increase or decrease the sensitivity of the light control device. This adjustment creates a sensitivity-adjusted signal. The sensitivity-adjusted signal may be demodulated and rectified as part of the process of creating the light control signal. Then another part of the process of creating the light control signal may include time-lapse magnifying the sensitivity-adjusted signal, and may also include inverse rectifying the sensitivity-adjusted signal, forming the resultant light control signal. The light control signal may then be supplied to the light source, thereby effectuating the illumination of the light source. The light control signal may be supplied to the light source with direct wiring or through wireless means, such as a radio frequency or infrared signal.

Preferably, one method of controlling a light source includes receiving an audible signal, operating on the audible signal, and outputting a light control signal based upon the operations performed on the audible signal. For example, a sensitivity-adjusted signal is preferably created based upon the audible signal. The sensitivity-adjusted signal may be responsive to the volume of the audible signal.

The sensitivity-adjusted signal may range between a minimum and maximum volume adjustment. In conjunction or separate from the sensitivity adjustment, the method of operation may include choosing an operation mode. One operation mode may include forming the light control signal such that: a light source is always on. A second operation mode may include forming the light control signal such that the light source is always off. A third operation mode may include forming the light control signal such that the light source is operable to turn on and off in relation to the audible signal.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A light control device for controlling a visual display of a light source comprising:

a transducer for receiving an audible signal produced by a remote speaker and creating an output signal based upon the audible signal; and a light controller for receiving the output signal and forming a light control signal to adjustably control the light source, wherein the light controller includes selectable operation modes, including a first mode in which the light control signal is operable to turn the light source on continuously and at a substantially steady luminescence, a second mode in which the light control signal is operable to turn the light source off, and a third mode in which the light control signal is operable to turn the light source on and off in response to the audible signal.

2. The light control device of claim 1, further comprising a sensitivity adjuster connected to the transducer to receive the output signal and form an adjusted signal output to the light controller.

3. The light control device of claim 1, whereby the light control signal is formed automatically based upon music.

4. The light control device of claim 1, whereby the light control signal is formed in response to user control.

5. A method of controlling at least one light source, comprising:

receiving an audible signal from an audio speaker;

creating a sensitivity-adjusted signal based upon the audible signal, wherein the sensitivity-adjusted signal is responsive to a volume of the audible signal; and outputting a light control signal in relation to the sensitivity-adjusted signal whereby the at least one light source is controlled in response to the light control signal, wherein outputting the light control signal includes selecting a mode of operation from a first mode in which the light control signal is operable to turn the light source on continuously and at a substantially steady luminescence, a second mode in which the light control signal is operable to turn the light source off, and a third mode in which the light control signal is operable to turn the light source on and off in response to the audible signal.

6. The method of claim 5 further comprising adjusting the sensitivity-adjusted signal along a volume range varying between a minimum adjustment corresponding to a minimum volume and a maximum adjustment corresponding to a maximum volume, whereby the light source is operable to illuminate in relation to the volume range.

7. The method of claim 5 wherein the sensitivity-adjusted signal is formed in response to user control.

* * * * *